US006009643A

United States Patent [19]

Maeba et al.

[11] Patent Number: 6,009,643

[45] Date of Patent: Jan. 4, 2000

[54] HYDRAULIC WORKING MACHINE

[75] Inventors: Eiji Maeba, Hiroshima; Hidetoshi Suzuki, Ogaki, both of Japan

[73] Assignee: Kabushiki Kaisha Kobe Seiko Sho, Kobe, Japan

[21] Appl. No.: 09/156,623

[22] Filed: Sep. 18, 1998

Related U.S. Application Data

[62] Division of application No. 08/645,714, May 14, 1996, Pat. No. 5,836,411.

[51] Int. Cl.[7] ..... E02F 3/32

[52] U.S. Cl. ..... 37/443; 37/466; 180/6.58

[58] Field of Search ..... 37/443, 410, 466; 180/6.58, 6.6, 6.48; 172/431, 432, 435, 436

[56] References Cited

U.S. PATENT DOCUMENTS

| | | | |
|---|---|---|---|
| 4,541,161 | 9/1985 | Shimoie | 37/443 X |
| 5,007,882 | 4/1991 | Mizumoto et al. | 37/443 |
| 5,040,851 | 8/1991 | Maeba . | |
| 5,711,095 | 1/1998 | Oda et al. | 37/443 X |
| 5,836,411 | 11/1998 | Maeba et al. | 180/6.58 |

FOREIGN PATENT DOCUMENTS

| | | | |
|---|---|---|---|
| 233782 | 5/1961 | Australia | 37/443 |
| 311082 | 4/1989 | European Pat. Off. | 37/443 |
| 60-226922 | 11/1985 | Japan | 37/443 |
| 4-1412 | 1/1992 | Japan . | |
| 5-22651 | 3/1993 | Japan . | |
| 5-125744 | 5/1993 | Japan . | |
| 406108494 | 4/1994 | Japan | 37/443 |
| 6-30247 | 4/1994 | Japan . | |
| 6-30250 | 4/1994 | Japan . | |
| 6-136789 | 5/1994 | Japan . | |
| 7-237458 | 9/1995 | Japan . | |
| 1 179 382 | 1/1970 | United Kingdom . | |
| 2 184 419 | 6/1987 | United Kingdom . | |
| 2 204 558 | 11/1988 | United Kingdom . | |

*Primary Examiner*—Victor Batson

*Attorney, Agent, or Firm*—Oblon, Spivak, McClelland, Maier & Neustadt, P.C.

[57] ABSTRACT

A hydraulic excavator includes a cab disposed on a front portion of a revolving upper structure. An internal combustion engine is mounted in a rear portion of the revolving upper structure, and an directional control valve is disposed in the front portion of the revolving upper structure at a position spaced laterally from the cab. The directional control valve is arranged longitudinally of the revolving upper structure. A hydraulic oil tank and a fuel tank for the internal combustion engine are disposed on either side of the directional control valve. By virtue of a space provided between the directional control valve and the cab, transmission of heat and operation noise from the directional control valve to the cab is greatly suppressed.

5 Claims, 6 Drawing Sheets

HYDRAULIC WORKING MACHINE

RELATED APPLICATION

This is a division of application Ser. No. 08/645,714, filed May 14, 1996 , now U.S. Pat. No. 5,836,411, issued on Nov. 17, 1998.

BACKGROUND OF THE INVENTION

1. Field of the Invention

The present invention relates to a hydraulic working machine such as a hydraulic excavator.

2. Description of the Related Art

Hydraulic excavators including a revolving upper structure rotatably mounted on a mobile lower structure or undercarriage and a driver's cab provided on the revolving upper structure are known in the art. It is also generally known that an internal combustion engine serving as a power source for a hydraulic motors is disposed in a rear portion of the revolving upper structure.

In the hydraulic working machine of the type described above, a directional control valve is mounted in the revolving upper structure for actuating various hydraulic cylinders, such as a boom hydraulic cylinder, and a swing hydraulic motor according to manipulation of control levers at the cab. A hydraulic oil tank and a fuel tank for the internal combustion engine are also mounted in the revolving upper structure. Conventionally, the directional control valve is disposed beneath the cab in which the control levers are provided.

The directional control valve while in operation generates heat and operation noise. According to the conventional arrangement, since the directional control valve is disposed beneath the cab, the heat and operation noise from the directional control valve are directly transmitted to the cab, posing severe discomforts on an operator. In addition, since the directional control valve is provided with a plurality of pipelines connected to the hydraulic cylinders and the swing hydraulic motor, the maintenance of the directional control valve ad the pipelines should necessarily involve a tedious and time-consuming cab-removing work.

Furthermore, the position of the directional control valve and the pipelines is important as it may increase the length of the pipelines extending from the directional control valve, which will bring increases in cost and hydraulic pressure loss. The directional control valve when arranged at a position susceptible to an external shock impact is likely to be damaged.

SUMMARY OF THE INVENTION

It is accordingly a first object of the present invention to provide a hydraulic working machine having a good maintainability.

A second object of the present invention is to provide a hydraulic working machine which is capable of suppressing transmission of heat and operation noise from a directional control valve to a cab, thereby improving working conditions of an operator.

A third object of the present invention is to provide a hydraulic working machine which is capable of reducing the length of pipelines connected with a directional control valve, thereby precluding increases in cost and hydraulic pressure loss.

A fourth object of the present invention is to provide a hydraulic working machine which is capable of protecting a directional control valve from an external shock impact.

According to a preferred embodiment of the present invention, there is provided a hydraulic working machine which comprises: an undercarriage; a revolving upper structure rotatable mounted on the undercarriage; a cab provided on a front portion of the revolving upper structure; an internal combustion engine mounted in a rear portion of the revolving upper structure; a hydraulic oil tank and a fuel tank for the internal combustion engine that are mounted in the revolving upper structure; and a directional control valve mounted in the front portion of the revolving upper structure at a position spaced laterally from the cab and arranged in the longitudinal direction of the revolving upper structure., The hydraulic oil tank is disposed between the directional control valve and the cab. It is further preferable that a cooling fan of the internal combustion engine is arranged such that air driven or forced from the cooling fan blows on the directional control valve.

Since the directional control valve is disposed on a side of the cab with a space defined therebetween, transmission of heat and operation noise from the directional control valve to the cab is greatly suppressed. By virtue of the space, the maintenance of the directional control valve and its pipelines can be readily achieved without involving a tedious and time-consuming work for removing the cab.

In the case where the hydraulic oil tank and the fuel tank for the internal combustion engine are disposed between the directional control valve and the cab, transmission of heat and operation noise for the directional control valve to the cab is further inhibited by these tanks. In this case, the maintenance of the directional control valve and associated pipelines is achievable form the opposite side of the directional control valve from the tanks. Furthermore, since the directional control valve is arranged in the longitudinal direction of the revolving upper structure, the space provided between the directional control valve and the cab is sufficiently large for accommodating tanks of larger capacities.

In addition, the directional control valve can be cooled by the cooling air forced by the cooling fan of the internal combustion engine. Generation of heat from the directional control valve, can, therefore, be further limited or suppressed with the result that the working conditions in the cab are further improved.

In the case where the directional control valve is disposed between the cab and the hydraulic oil tank and the fuel tank, the tanks prevent an eternal shock impact from transmitting to the directional control valve. Since the directional control valve is disposed adjacent to a swing axis of the revolving upper structure, it is possible to centralize the pipelines of the directional control valves at the position near the swing axis of the revolving upper structure.

By virtue of the longitudinal arrangement of the directional control valve, a relatively large space is provided between the directional control valve and the cab, which space can be used as a piping space. The pipelines connected to the directional control valve can, therefore, be arranged in a concentrated or centralized manner within the piping space and, hence, they are extremely easy to maintain. The centralized arrangement of the pipelines further offers reduction in length of the pipelines and corresponding reductions in cost and hydraulic pressure loss.

The above and other object, features and advantages of the present invention will become manifest to those versed in the art upon making reference to the detailed description and accompanying sheets of drawings in which preferred structural embodiments incorporating the principles of the present invention are shown by way of illustrative example.

DESCRIPTION OF THE PREFERRED EMBODIMENTS

Certain preferred structural embodiments of the present invention will be described below in greater detail with reference to the accompanying sheets of drawings.

Figure 1:
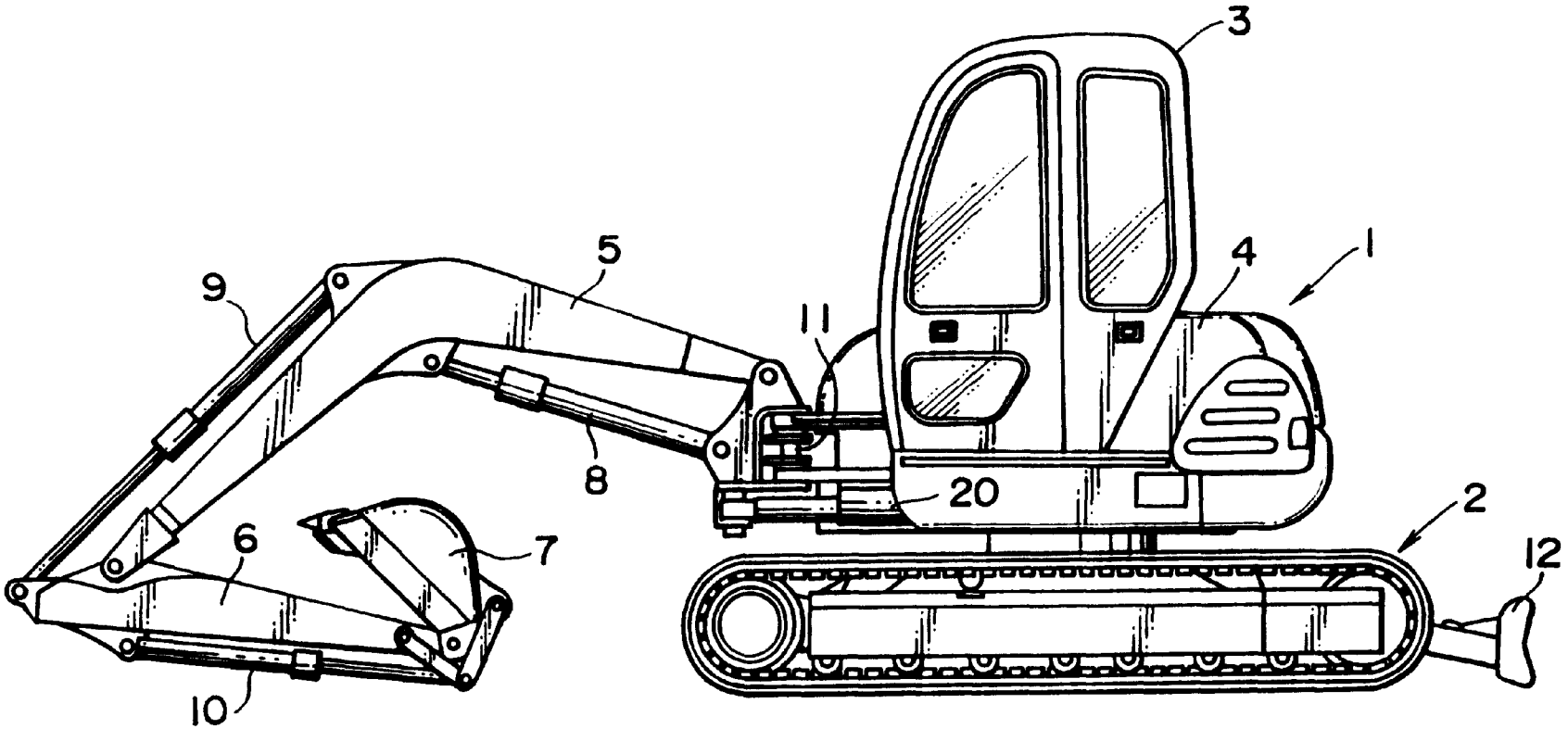
FIG. 1 is a side view of a hydraulic excavator constituting a hydraulic working machine according to a first embodiment of the present invention.

FIG. 1 shows the general construction of a hydraulic working machine (hydraulic excavator) according to a first embodiment of the present invention. The hydraulic excavator includes a revolving upper structure 1 rotatably mounted on a mobile lower structure or undercarriage 2. The revolving upper structure 1 further includes a housing 4 so provided. The revolving upper structure 1 further includes a housing 4 so constructed as to surround a right side and a rear side of a lower portion of the cab 3 and contain various apparatus described later on. The revolving upper structure 1 has a front end from which a boom 5, an arm 6, and a bucket 7 extend in the order named. The boom 5, the arm 6 and the bucket 7 are pivotally movable in a vertical plane. The boom 5 is rotatably mounted on a vertical post 11 disposed on the front end of the revolving upper structure 1 so that the boom 5 can swing or revolve about the vertical post 11 in a horizontal plane and relative to the revolving upper structure 1. 12 is a dozer.

The first embodiment of the present invention will be described in further detail with reference to FIG. 2. The housing 4 contains therein an internal combustion engine 13, a directional control valve 14, a hydraulic oil tank 15, a fuel tank 16 for the internal combustion engine 13, and the like.

The internal combustion engine 13 is mounted in the revolving upper structure 1 at a position located rearward fo the cab 3. The internal combustion engine 13 is arranged transversely of the revolving upper structure 1 with its crankshaft (not shown) aligned with the transverse direction (widthwise or lateral direction) of the revolving upper structure 1. The internal combustion engine 13 is provided with a cooling fan 17 and a radiator 18 that are disposed on the right side of the engine 13, and also with a hydraulic pump 19 which is disposed on the left side of the engine 13 and driven by the engine 13.

The directional control valve 14 is mounted in the housing 4 at a position adjacent to a front right side of the revolving upper structure 1 and arranged longitudinally of the revolving upper structure with its longitudinal axis aligned with the longitudinal direction of the revolving upper structure 1. The directional control valve 14 is disposed close to the cooling fan 17 of the internal combustion engine 13. Cooling air driven or forced by the cooling fan 17 first passed through the radiator 18 to cool the same, and thereafter, as indicated by the arrows in FIG. 2, the cooling air strikes against a sidewall 4*a* of the housing whereupon the direction of flow of the cooling air is reflected toward the directional control valve 14. Subsequently, the cooling air flows longitudinally along the directional control valve 14 and finally is discharged from the housing 4 through a vent hole 4*b* formed in the sidewall 4*a* of the housing 4.

The fuel tank 16 and the hydraulic oil tank 15 are mounted in the housing 4 at a position between the directional control valve 14 and the cab 3, with the fuel tank 16 located forwardly of the hydraulic oil tank 15 in the longitudinal direction of the revolving upper structure 1. The fuel tank 16 has a portion projecting transversely toward a front end of the directional control valve 14 so as to increase the volume or capacity of the fuel tank 16.

A swing hydraulic cylinder 20 for oscillating or swinging the boom 5 about the vertical post 11 with respect to the revolving upper structure 1 is disposed below the cab 3 of the revolving upper structure 1 and extends substantially in the longitudinal direction of the revolving upper structure 1. The swing hydraulic cylinder 20 is pivotally connected at its rear end to the revolving upper structure 1 and has a piston rod 21 movable back and forth to project forwardly of the revolving upper structure 1. The piston rod 21 has an outer end pivotally connected to a boom mount 22 by means of which the boom 5 is mounted on the vertical post 11. When the swing hydraulic cylinder 20 is activated to extend and contract (i.e., reciprocate) the piston rod 21, the boom 5 oscillates relative to the revolving upper structure 1 in the clockwise and counterclockwise directions about the vertical post 11. During that time, the swing hydraulic cylinder 20 oscillates about its pivoted read end.

A swing hydraulic motor 24 for revolving the revolving upper structure 1 via a swing bearing 23, and a swivel joint 25 for supplying a working fluid form the revolving upper structure 1 side to a traveling hydraulic motor (not shown) in the undercarriage 2 are disposed in a central portion of the revolving upper structure 1 located below the cab 3.

Figure 2:
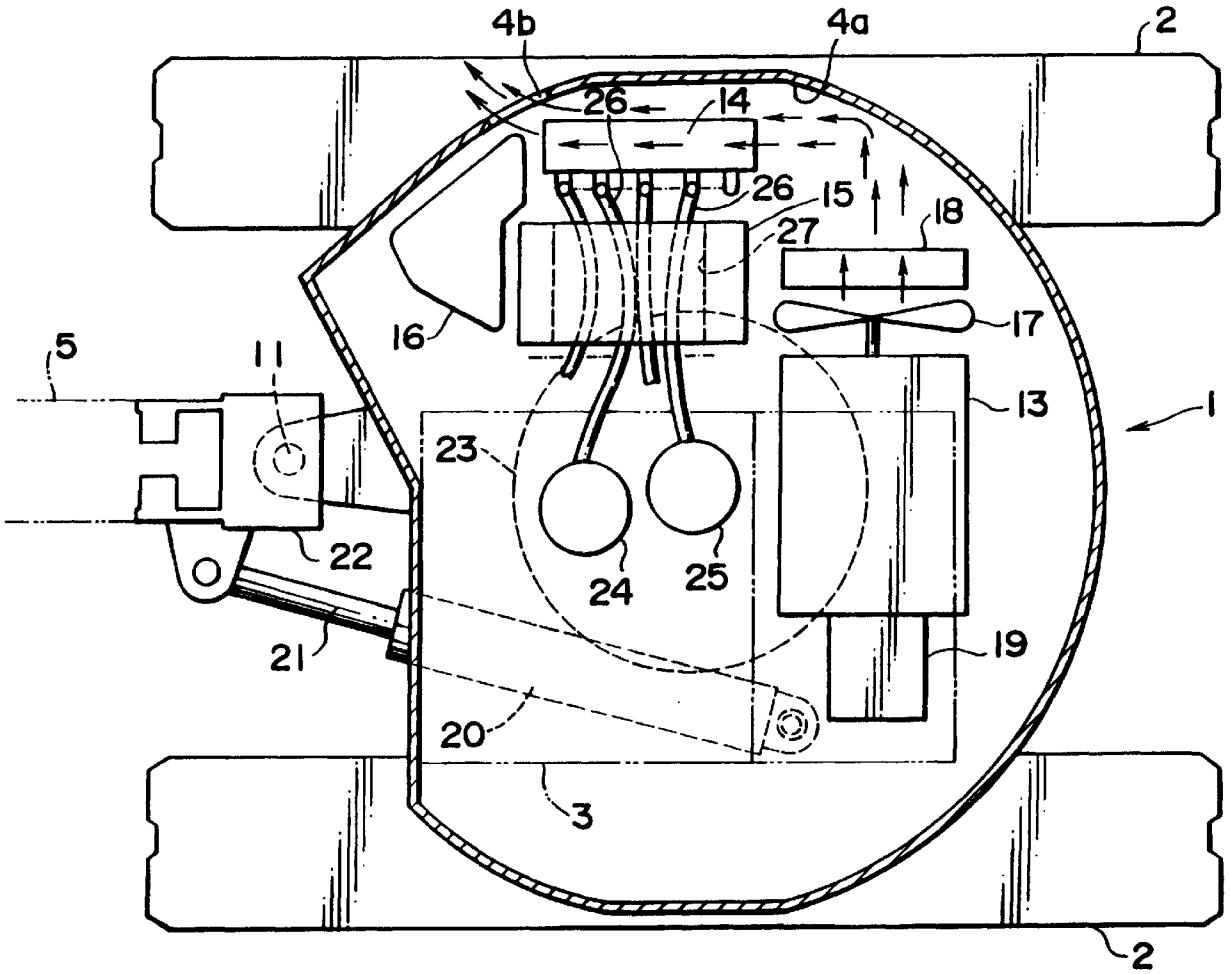
FIG. 2 is a diagrammatical plan view showing the layout of various apparatus mounted on a revolving upper structure of the hydraulic excavator.
Figure 3:
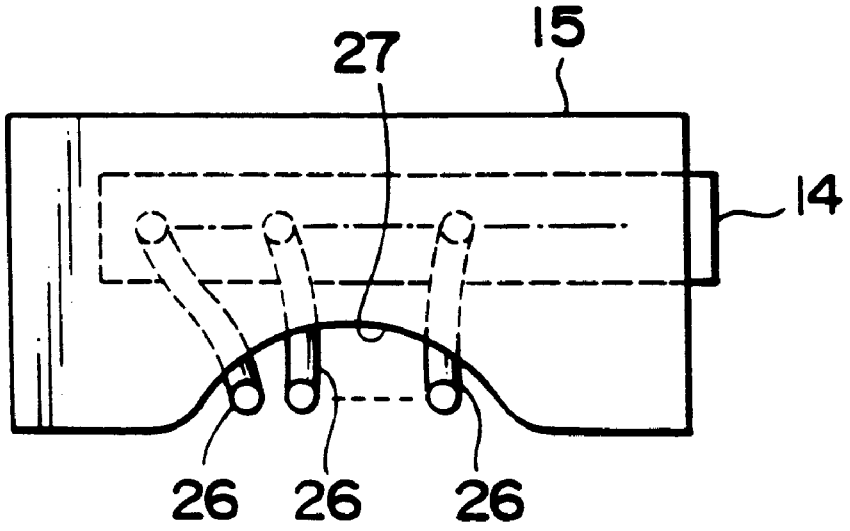
FIG. 3 is a side view of a hydraulic oil tank mounted on the revolving upper structure of the hydraulic excavator.

In FIG. 2 reference numeral 26 denotes a plurality of pipelines connected to the directional control valve 14. The hydraulic oil tank 15 which is disposed in juxtaposition to the directional control valve 14 has a recessed portion 27 formed in its undersurface, as shown in FIG. 3. The pipings 26 connected at one end to the directional control valve 14 pass through the recessed portion 27 of the hydraulic oil tank 15 and are connected at the opposite end to the swing hydraulic motor 24, the swivel joint 25 and other hydraulic devices.

The revolving upper structure 1 has a size determined such that a maximum swing area drawn by an outer peripheral surface of the revolving upper structure 1 is well within the overall width of the hydraulic shovel including the undercarriage 2.

In the hydraulic excavator of the first embodiment, the directional control valve 14 while in operation reaches a high temperature (about 90° C., for example) and emits operation noise. In this instance, however, since the directional control valve 14 is spaced far away from the cab 3, and since the hydraulic oil tank 15 and the fuel tank 16 are disposed between the directional control valve 14 and the cab 3, the tanks 15, 16 form an obstruction which substantially blocks transmission of heat and operation noise from the directional control valve 14 to the cab 3. This will offer a great improvement in environmental conditions of the operator working inside the cab 3, insuring comfortable working of the operator.

In addition, since the directional control valve 14 is disposed close to the right side edge (sidewall 4*a*) of the revolving upper structure 1 and arranged in the longitudinal direction of the revolving upper structure 1, there is a relatively large space provided between the directional control valve 14 and the cab 14. The hydraulic oil tank 1 and the fuel tank 16 that are disposed in this relatively large space are allowed to have an increased capacity. The directional control valve 14 disposed close to the right side edge of the revolving upper structure is readily accessible from the right side of the revolving upper structure when the maintenance of the directional control valve 14 is necessary. The directional control valve 14, therefore, has a good maintainability.

In the hydraulic excavator of the first embodiment, the cooling air forced from the cooling fan 17 of the internal combustion engine 13 blows on the directional control valve 14 vie the radiator 18 and thereby control the generation of heat from the directional control valve 14. In practice, the cooling air just leaving the radiator 18 has a temperature around 70° C. However, since the temperature of the directional control valve 14 while in operation rises up to 90° C. as previously described, the cooling air generated by the rotating cooling fan 17 is able to offer a sufficient cooling effect to control or prevent generation of heat from the directional control valve 14.

Figure 4:
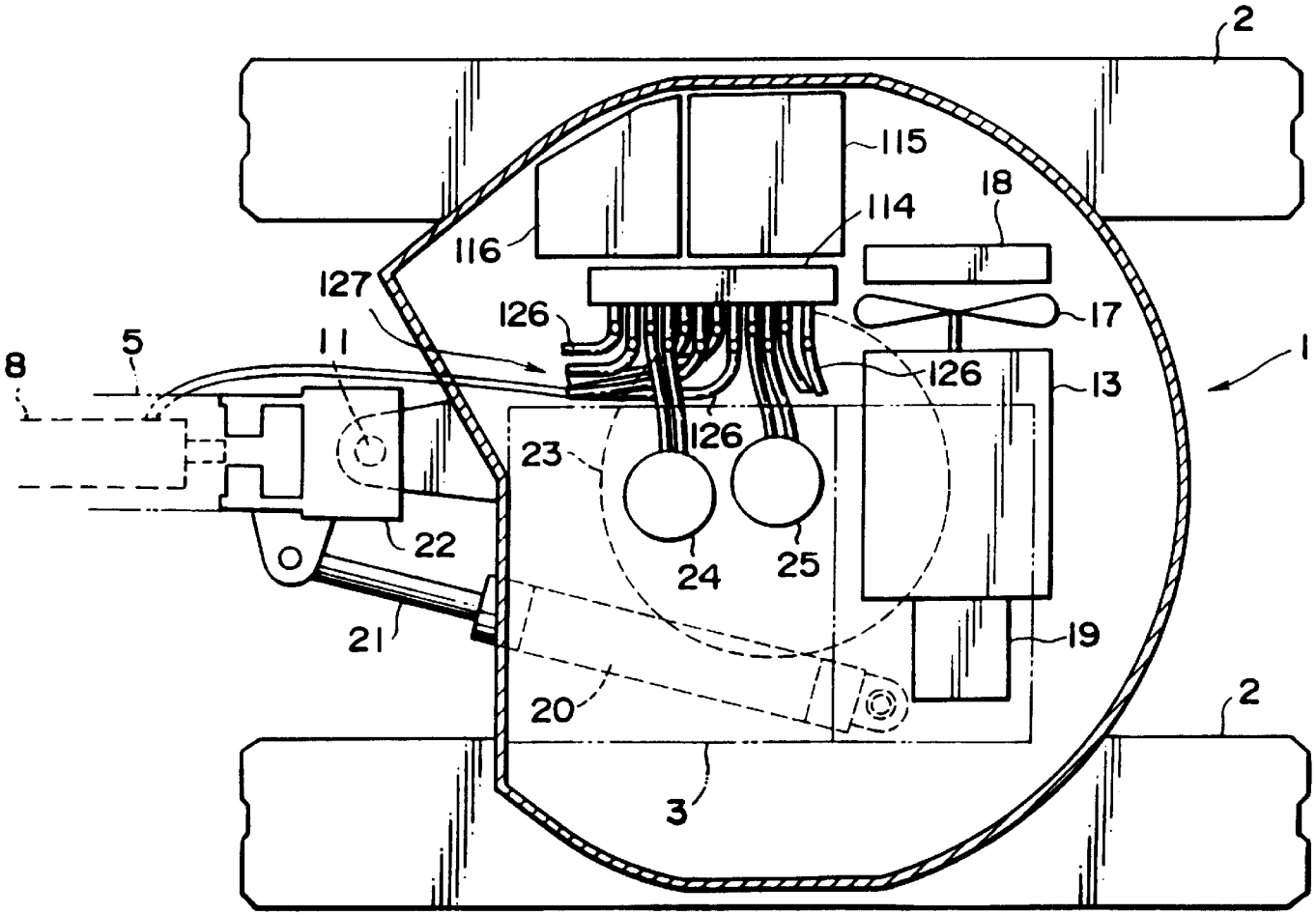
FIG. 4 is a diagrammatical plan view showing the layout of various apparatus mounted on the revolving upper structure of a hydraulic excavator according to a second embodiment of the present invention.
Figure 5:
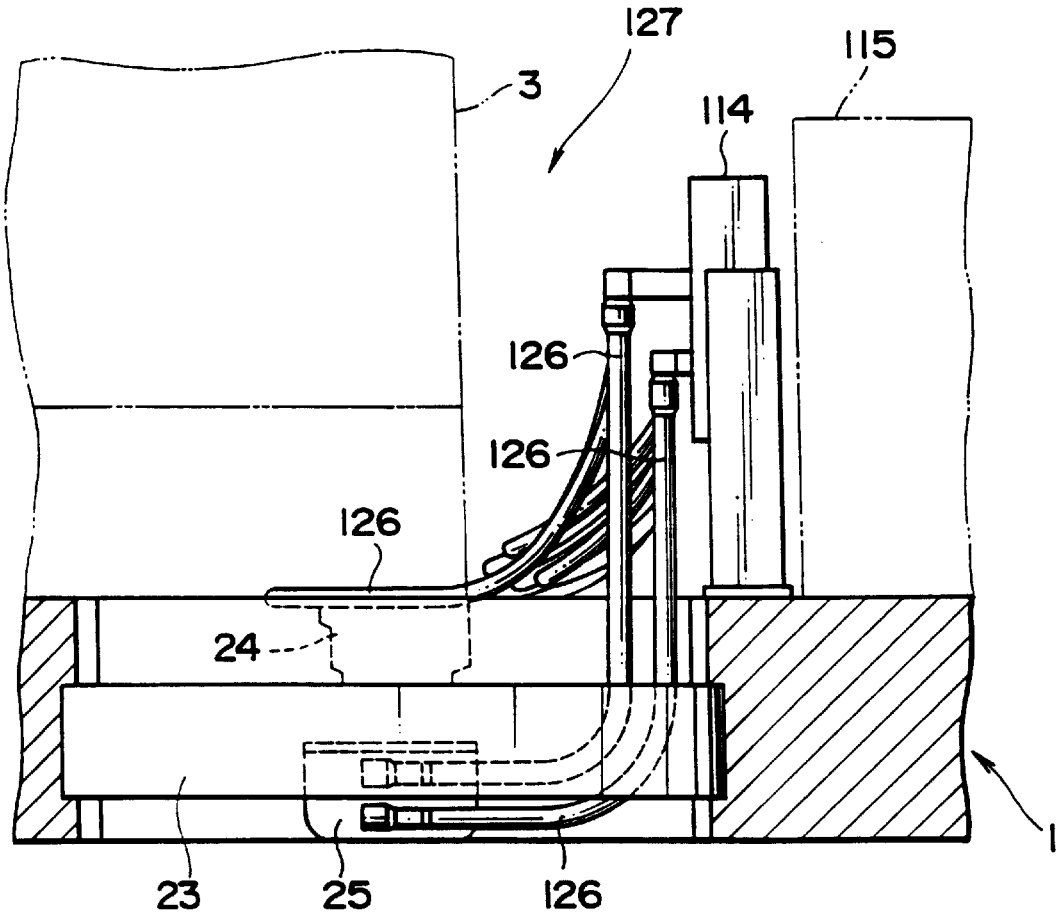
FIG. 5 is a rear view illustrative of a directional control valve and a space for piping mounted on the revolving upper structure of the hydraulic excavator of the second embodiment.

Referring now to FIGS. 4 and 5, a second embodiment of the present invention will be described below in greater detail. In FIGS. 4 and 5, these parts which are identical to those described in the first embodiment are designated by identical reference characters. The revolving upper structure 1 has a housing 4 containing therein an internal combustion engine 13, a directional control valve 114, a hydraulic oil tank 115, a fuel tank 116 for the internal combustion engine 13, and the like.

The fuel tank 116 and the hydraulic oil tank 115 are mounted in the housing 4 at a position adjacent to a front right side of the revolving upper structure 1, with the fuel tank 116 located forwardly of the hydraulic oil tank 115 in the longitudinal direction of the revolving upper structure 1.

The directional control valve 114 is mounted in the housing 4 at a position which is located between a cab 3 and the fuel tank 116 and the hydraulic oil tank 115 and close to an axis of rotation (swing axis) of the revolving upper structure 1. The directional control valve 114 is arranged in the longitudinal direction of the revolving upper structure 1. By virtue of this arrangement, there is a relatively large space provided between the cab 3 and the directional control valve 114. This space is used as a piping space 127 for receiving a plurality of pipelines 126 extending from the directional control valve 114. A boom 5 is located forwardly of the piping space 127.

As shown in FIG. 4, the pipelines 126 connected at one end to the directional control valve 114 pass through the piping space 127 and are connected at the opposite end to a plurality of hydraulic devices including a boom hydraulic cylinder, an arm hydraulic cylinder and a bucket hydraulic cylinder (neither shown but identical to those designated, respectively, by 9 and 10 in FIG. 1), as well as to a swivel joint 25. As shown in FIG. 5, the piping space 127 receives therein the pipelines 126 in a concentrated or centralized manner. The pipelines 126 extending from the direction control valve 114 toward the boom hydraulic cylinder 8, the arm hydraulic cylinder 9 and the bucket hydraulic cylinder 10 (see FIG.1) are laid linearly in the section of arrangement of these hydraulic cylinders 8–10, The directional control valve 114 is disposed close to a swing hydraulic motor 24 and the swivel joint 25 are shorter in length than those 26 used in the first embodiment shown in FIG. 2.

In the hydraulic excavator of the second embodiment, the directional control valve 114 while in operation reaches a relatively high temperature and generates operation noise. In this instance, however, since the directional control valve 114 is laterally spaced from the cab 3 with the relatively large piping space 127 defined therebetween, transmission of heat and operation noise from the directional control valve 114 to the cab 3 is considerably attenuated by the piping space 127 and does not take place directly. Environmental conditions of the operator working inside the cab 3 can, therefore, be improved to such an extend that the operator can perform the operating task under a comfortable condition.

Furthermore, by virtue of the hydraulic oil tank 115 and the fuel tank 116 disposed adjacent to the right side edge of the revolving upper structure 1, the directional control valve 114 is protected against contact form the exterior of the revolving upper structure 1. Thus, the directional control valve 114 is perfectly protected against damage even when the revolving upper structure 1 hits on an external object.

When the maintenance of the directional control valve 114 or the pipelines is necessary, an appropriate maintenance work can be readily achieved by using the relatively large piping space 127. In addition, since the pipelines 126 are centralized in the piping space 127, they can be maintained with utmost ease. Furthermore, by virtue of the directional control valve 114 disposed adjacent to the swing axis of the revolving upper structure 1, the distance between the directional control valve 114 and various hydraulic devices or actuators is relatively short and, hence, the necessary length of the pipelines extending between the directional control valve 114 and these hydraulic actuators can be reduced correspondingly. The use of the shorter pipelines poses noticeable reductions in material cost and hydraulic pressure loss.

Figure 6:
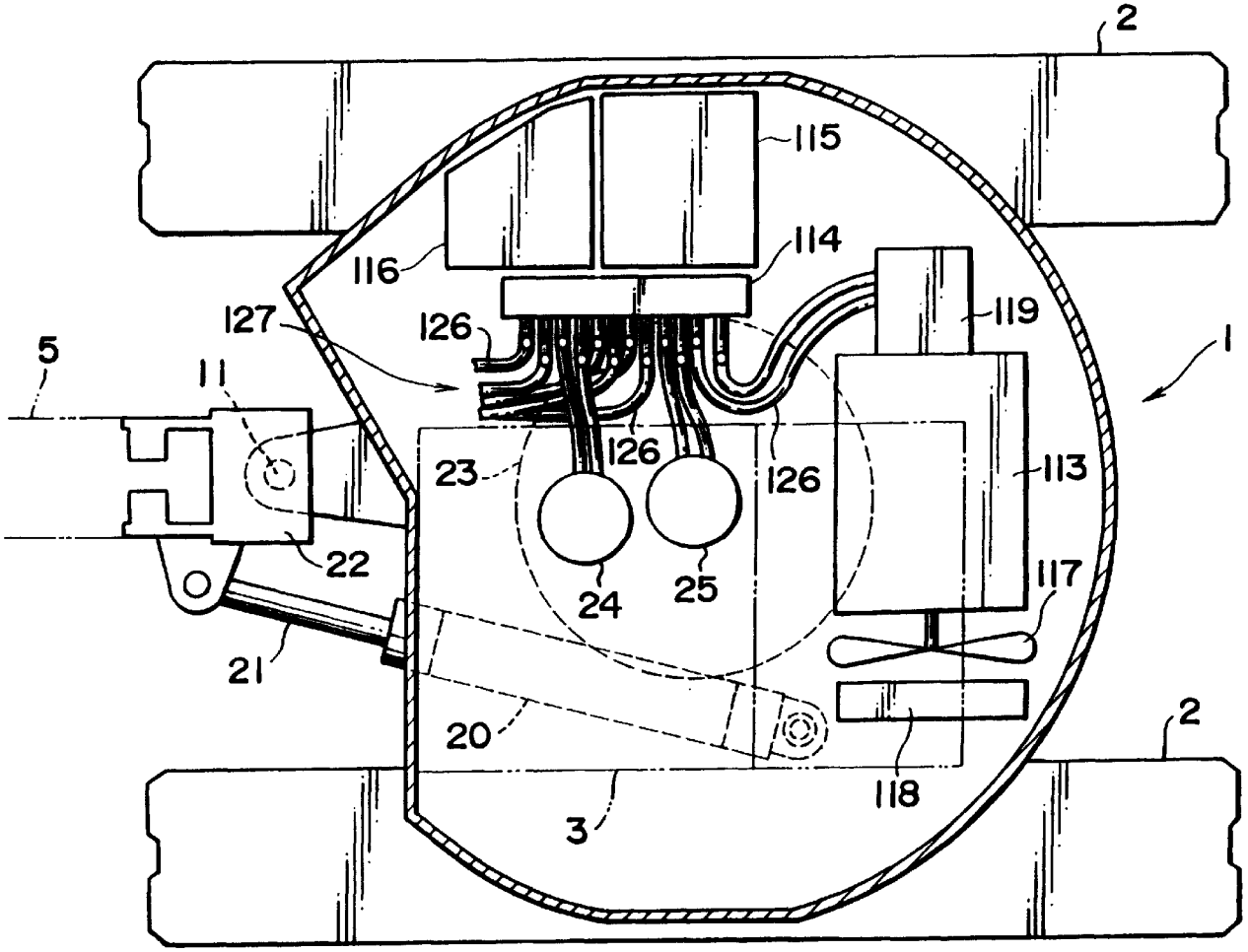
FIG. 6 is a diagrammatical plan view showing the layout of various apparatus mounted on the revolving upper structure of a hydraulic excavator according to a third embodiment of the present invention.

Then, a third embodiment of the present invention will be described below in greater detail with reference to FIG. 6, In FIG. 6, these parts which are identical to those shown in other drawing figures are designated by identical reference characters.

The third embodiment includes an internal combustion engine 113 arranged inversely to the engine of the second embodiment. More particularly, the internal combustion engine 113 includes a hydraulic pump 119 on its right side, and a cooling fan 117 and a radiator 118 on its left side. This arrangement is advantageous in that since the distance between the directional control valve 114 and the hydraulic pump 119 and, hence, the length of pipelines 126 extending between the directional control valve 114 and the hydraulic pump 119 can be reduced, a corresponding reduction in cost can be attained.

In the embodiments described above, the fuel tank is disposed in front of the hydraulic oil tank in the longitudinal direction of the revolving upper structure, however, it may be possible to arrange the hydraulic oil tank forwardly of the fuel pump.

The cab in each of the foregoing embodiments is of the cabin type, however, an "open" type cab having a seat and control levers exploded to the air may be employed.

Furthermore, the hydraulic working machine described in each of the foregoing embodiments is composed of a hydraulic excavator, however, the present invention can be usefully applied to other hydraulic working machines such as a small-sized hydraulic mobile, crane.

Obviously, various minor changes and modifications of the present invention are possible in the light of the above teaching. It is therefore to be understood that within the scope of the appended claims the invention may be practiced otherwise than as specifically described.

What is claimed:

1. A hydraulic working machine comprising:

an undercarriage;

a revolving upper structure rotatably mounted on said undercarriage;

a cab provided on a front portion of said revolving upper structure;

an internal combustion engine disposed in a rear portion of said revolving upper structure;

a directional control valve disposed in said front portion of said revolving upper structure at a position spaced laterally from said cab and arranged along a direction extending from the rear portion to the front portion of said revolving upper structure; and a hydraulic oil tank and a fuel tank for said internal combustion engine that are disposed in said revolving upper structure, wherein said hydraulic oil tank is disposed between said directional control valve and said cab.

2. A hydraulic working machine according to claim 1, wherein said fuel tank for said internal combustion engine is disposed forwardly of said hydraulic oil tank.

3. A hydraulic working machine according to claim 1, wherein said hydraulic oil tank has an undersurface including a recessed portion, said directional control valve being connected with a plurality of pipelines, at least one of said pipelines passing through said recessed portion.

4. A hydraulic working machine comprising;

an undercarriage;

a revolving upper structure rotatably mounted on said undercarriage;

a cab provided on a front portion of said revolving upper structure;

an internal combustion engine disposed in a rear portion of said revolving upper structure;

a directional control valve disposed in said front portion of said revolving upper structure at a position spaced laterally from said cab and arranged along a direction extending from the rear portion to the front portion of said revolving upper structure; and a hydraulic oil tank and a fuel tank for said internal combustion engine that are disposed in said revolving upper structure, wherein said fuel tank is disposed between said directional control valve and said cab.

5. A hydraulic working machine comprising:

an undercarriage;

a revolving upper structure rotatably mounted on said undercarriage;

a cab provided on a front portion of said revolving upper structure;

a directional control valve disposed in said front portion of said revolving upper structure at a position spaced laterally from said cab and arranged along a direction extending from the rear portion to the front portion of said revolving upper structure; and an internal combustion engine disposed in a rear portion of said revolving upper structure, wherein said internal combustion engine includes a cooling fan, said cooling fan being so arranged as to force air toward said directional control valve;

a hydraulic oil tank and a fuel tank for said internal combustion engine that are disposed in said revolving upper structure.

* * * * *